US007410077B2

(12) United States Patent
Ness

(10) Patent No.: US 7,410,077 B2
(45) Date of Patent: Aug. 12, 2008

(54) STORAGE CONTAINER AND DISPENSER FOR ROLLED WEB PRODUCTS

(76) Inventor: Mark Byron Ness, P.O. Box 1460, Gig Harbor, WA (US) 98335-3460

( * ) Notice: Subject to any disclaimer, the term of this patent is extended or adjusted under 35 U.S.C. 154(b) by 232 days.

(21) Appl. No.: 11/185,358

(22) Filed: Jul. 20, 2005

(65) Prior Publication Data

US 2007/0018023 A1 Jan. 25, 2007

(51) Int. Cl.
*B65H 16/00* (2006.01)

(52) U.S. Cl. ..... 221/120; 221/112; 221/113; 221/119; 221/121; 242/160.1; 242/159; 206/389

(58) Field of Classification Search ..... 221/1–312 C
See application file for complete search history.

(56) References Cited

U.S. PATENT DOCUMENTS 1,462,333 A * 7/1923 Girard ..... 242/538
1,902,826 A * 3/1933 Bobo ..... 242/532.5
2,336,496 A * 12/1943 Miller ..... 40/516
3,546,850 A 12/1970 Hatanaka et al.
5,941,476 A 8/1999 Copass
6,003,668 A 12/1999 Joyce
2003/0230665 A1 * 12/2003 Small ..... 242/559

* cited by examiner

*Primary Examiner*—Gene O. Crawford
*Assistant Examiner*—Michael K Collins
(74) *Attorney, Agent, or Firm*—QuickPatents, Inc.; Kevin Prince

(57) ABSTRACT

A container is disclosed for storage and dispensing of web roll products such as gift wrap. The container includes an elongated housing. A cylindrical barrel assembly is rotatably supported within the housing, and includes a plurality of roll storage cavities each having an open end and an open slot along a length thereof. A second end panel of the housing includes a rotatable cap frictionally attached to one end of the barrel assembly to rotate the barrel assembly within the housing. Removable storage boxes for storing gift-wrap related accessories are attachable to the housing. Wheels may be included on the housing to facilitate rolling the container.

5 Claims, 3 Drawing Sheets

STORAGE CONTAINER AND DISPENSER FOR ROLLED WEB PRODUCTS

FIELD OF THE INVENTION

This invention relates to storage containers, and more particularly to a storage container for rolled products such as wrapping paper.

DISCUSSION OF RELATED ART

Gift wrap is typically supplied to consumers on elongated rolls of about 30 inches in length. Consumers often store multiple such rolls in closets, under beds, in drawers, and the like, but the drawbacks associated with such disorganized storage areas are many. For example, having multiple rolls of gift wrap stored in a drawer makes it difficult to find any particular roll, since the other rolls may be stacked above the desired roll and many of these rolls may be in various stages of unrolling. When paper unrolls in such a drawer or other storage areas, it often becomes creased or torn, and thereafter must be discarded as waste.

Further, due to the disparity between the dimensions of a typical roll of gift wrap and related accessories, such as rolls of tape, ribbon, paper clips, tags, labels, scissors, pens, and the like, it is often disadvantageous to store such items together. Locating a pair of scissors under a stack of multiple rolls of gift wrap and ribbon typically results in the further disorganization of the storage area, as disturbing rolls of gift wrap that are not secured in some fashion, such as by rubber band or the like, usually results in the roll of gift wrap unrolling.

Various products have been devised to keep rolled web-type material such as gift wrap stored in an organized fashion. For example, U.S. Patent application 2003/0230665 to Small on Dec. 18, 2003 discloses a gift wrap cutting and holding system with a rotating holder. Such a device, while maintaining a plurality of rolls of gift wrap organized, is itself difficult to store and does not prevent dust or dirt from settling on the rolls of gift wrap. Further, no provision is made in such a device for storing scissors, ribbons, tape, and related gift wrapping accessories.

U.S. Pat. No. 6,003,668 to Joyce on Dec. 21, 1999, and U.S. Pat. No. 5,941,476 to Copass on Aug. 24, 1999, each disclose a covered gift wrap holder for rolls. Such devices have similar drawbacks to the Small device in that provision is not included for storing gift wrap accessories. Further, such devices provide little protection against the gift wrap from unrolling while being stored, as the free end of the gift wrap on each roll is open to the container and as such is free to unroll. U.S. Pat. No. 5,819,935 ot Lawson on Oct. 13, 1998 discloses a similar device with similar drawbacks.

U.S. Pat. No. 3,546,850 to Hatanaka et al on Dec. 15, 1970 discloses a complicated coin-operated wrapping paper storage and dispensing machine. A rotary disk with a plurality of holders provides a multiple gift wrap roll storage and dispensing device that does not have many of the drawbacks mentioned heretofore, but is quite complex in its design. Each roll of gift wrap has electronic dispensing means between frictional rollers that keep the rolls from unrolling while stored. Such a device is too costly for the average consumer to purchase, and would additionally require ample space to store.

U.S. Pat. No. 2,336,496 to Miller on Dec. 14, 1943, illustrates a map or chart holder that includes a rotating cylinder with a plurality of maps or charts wound on spring-loaded shafts. Such a device, while useful for maps or charts that are to be retained, is not suitable for gift wrap or other web product that is meant to be dispensed.

U.S. Pat. No. 1,462,333 to Girard on Jul. 17, 1923, illustrates a fabric dispenser that includes a plurality of holding cylinders with longitudinal slots, all of the cylinders being retained at one end thereof around a common circumference of a rotating disk. Such a device does not make provision for the storage of accessory items and is itself difficult to stow away. Further, the longitudinal slots formed in the cylinders of such a device, designed for the egress of the fabric or web product to be dispensed thereby, are too small for a user's fingers to be able to reach into the cylinder to grasp the free end of the rolled product. As a result, such a device is difficult and frustrating to use.

Clearly, then, there is a need for a storage and dispensing container for gift wrap and other rolled products that overcomes the aforementioned drawbacks. Such a needed device would provide storage and quick dispensing for a plurality of such rolls, yet keep dust and debris away from the rolls when stored. Such a needed device would provide for auxiliary storage of related accessories, such as tape, scissors, gift bags, or the like, and would be easy to stack one on another. Moreover, such a needed device would facilitate the quick location of a desired gift wrap roll, such roll being easy to remove from the device if desired. The present invention accomplishes these objectives.

SUMMARY OF THE INVENTION

The present device is a storage and dispensing container for convenient storage and dispensing of web roll products such as gift wrap. The container of the present invention includes an elongated housing having a top panel with an elongated slot therein, and three side panels. The side panels and the top panel essentially form a hollow tube with a square cross-section. Further, the housing includes a first end panel and a second end panel. The first end panel is hingably attached to one side panel.

A cylindrical barrel assembly is rotatably supported within the housing, and includes a plurality of roll storage cavities each having an open end and an open slot along a length thereof and open to the outside surface of the barrel assembly. As such, the barrel assembly may be rotated within the housing to align the open slot of a desired cavity with the elongated slot of the top panel of the housing. As such, one of the gift wrap rolls stored in the desired cavity of the barrel assembly may be dispensed therethrough, either by manually removing the roll or by grasping the gift wrap sheet itself and pulling away from the container.

Arcuate corner panels are frictionally retained between elongated and concave center ridges of each adjacent top panel or side panel. Such arcuate corner panels cooperate in curvature with the concave center ridges to form a generally cylindrical void for rotatably retaining the barrel assembly therein. The arcuate corner panels each further form one side of a generally triangular open area within the housing where additional rolls of gift wrap or other items may be stored. Such open areas within the housing can be easily accessed by opening the first end panel.

Preferably the barrel assembly further includes a hollow portion formed from one end to the other thereof for storing additional gift wrap rolls or other items. While gift wrap stored therein is not dispensable through the open slot, such rolls are conveniently accessed by opening the first end panel.

The second end panel preferably includes a circular cut-out centered within the generally square end panel. A rotatable cap is frictionally attached to one end of the barrel assembly with locking tabs, the cap at least partially protruding from the circular cut-out, such that rotating the cap causes the barrel assembly to rotate within the housing.

A first storage box is preferably included for covering the elongated slot of the top side. The first storage box and the top side further include frictional engagement means for temporarily securing the first storage box to the top side of the housing. A second storage box is preferably included for removable attachment to one of the side panels, and a frictional engagement means is included for securing the second storage box to the one side panel of the housing. The second storage box is preferably open on a side adjacent to the top side of the housing when the second storage box is fixed to the one side panel. As such, with both the first storage box and the second storage box retained on the housing, the first storage box covers the open side of the second storage box, thereby keeping any items stored in the second storage box retained therein. One such item is preferably a third storage box, sized accordingly to fit securely within a portion of the second storage box.

Wheels may be included in the first end panel, or on opposing side panels, such that when the container is rested on the wheels the container may be easily rolled along a surface. A handle may be included on or formed in a part of the housing opposite the wheels to facilitate the rolling the housing along the surface.

The present invention achieves the objectives of providing convenient storage and dispensing of rolled web products, as well as the objective of keeping such products dust-free while stored. The present device may be disassembled and packaged in a compact fashion to facilitate transportation and retail display thereof, and then easily assembled for use. Multiple such containers may be stacked easily due to the regular parallelepiped shape of the container. Moreover, such a container of the present invention provides for convenient auxiliary storage of related accessories, such as tape, scissors, gift bags, or the like. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The present invention is a web roll storage and dispensing container 10 for convenient storage and dispensing of web roll products 90 such as gift wrap, screen material, fabric and like products. The preferred embodiment herein described is for use principally with gift wrap 90 (FIG. 2), but could clearly be used to store and dispense other products.

Figure 1:
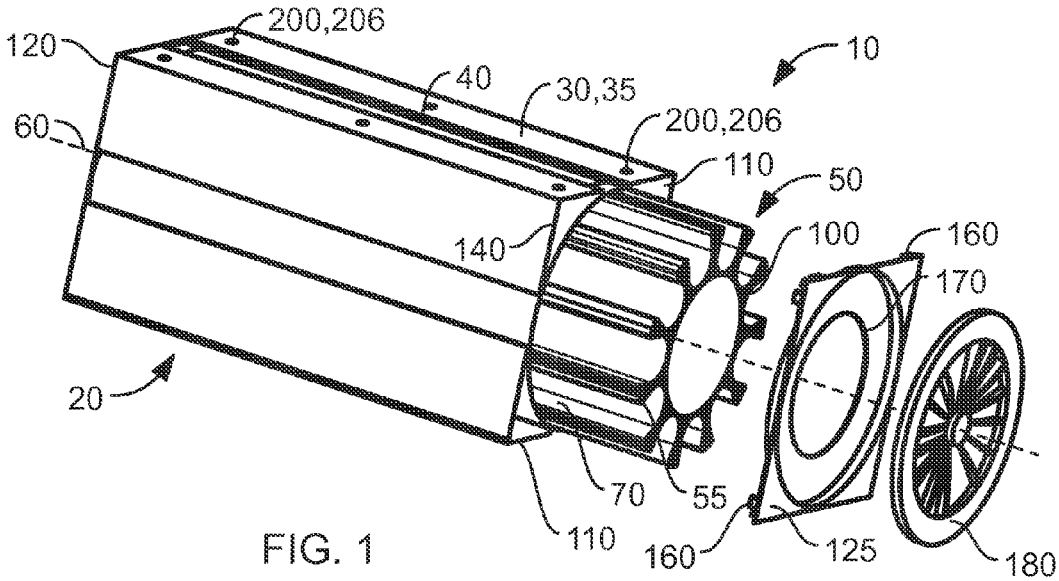
FIG. 1 is a partial exploded view of the invention, illustrating a rotating cap fixed to a barrel assembly through an end panel, the barrel assembly being supported within a housing.
Figure 5:
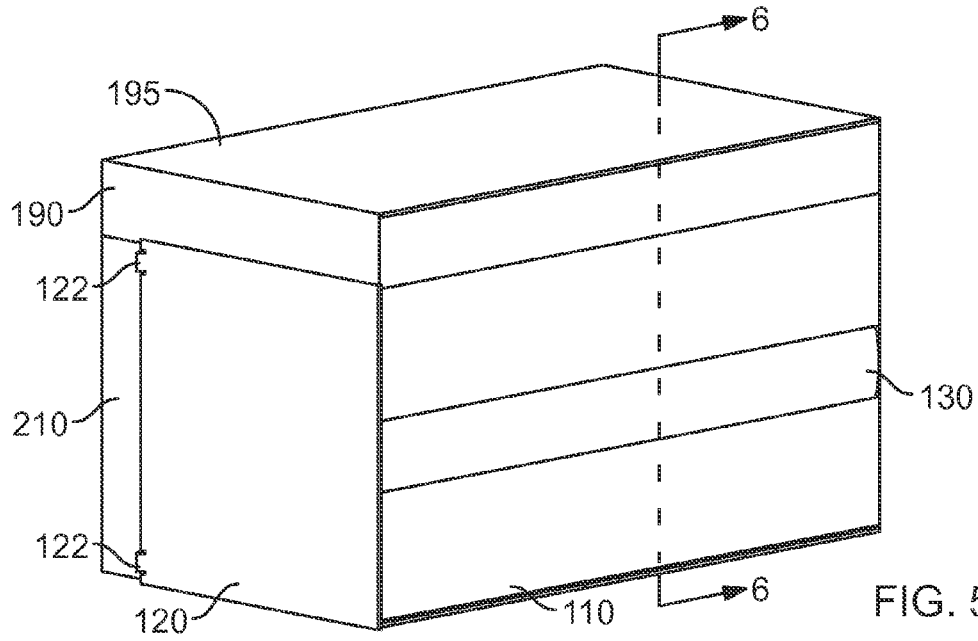
FIG. 5 is a perspective view of the invention, illustrating an end panel through which rolled products may be inserted into the cavities of the barrel assembly.
Figure 6:
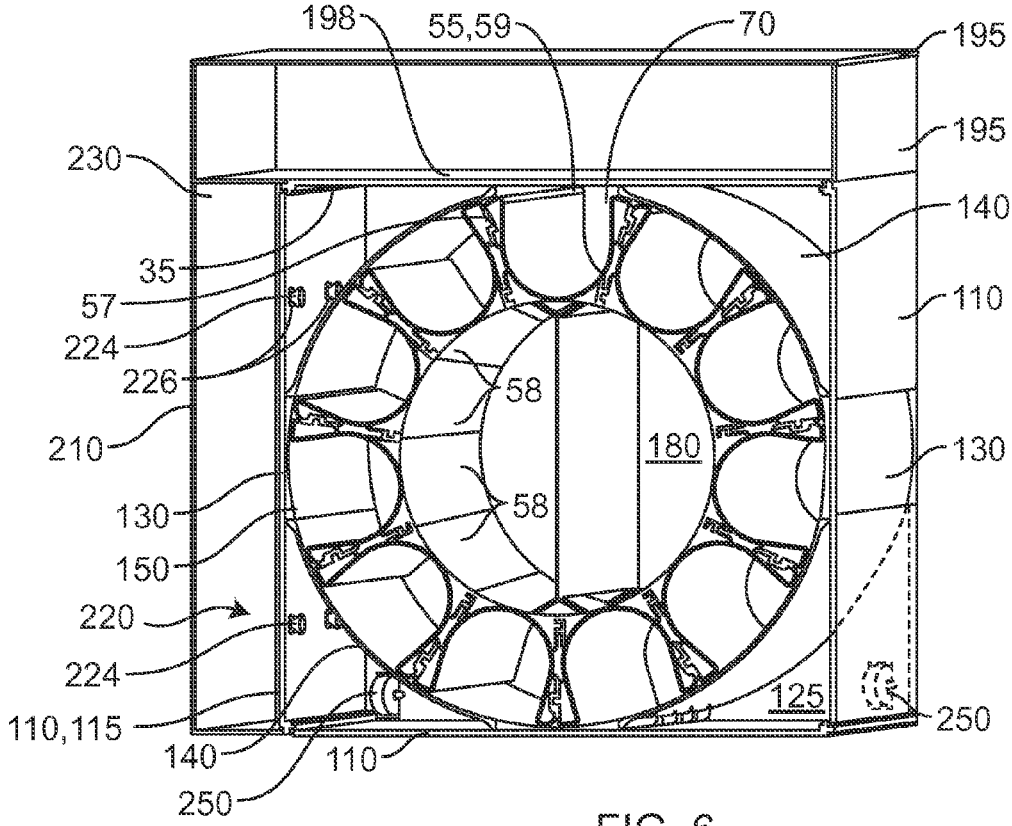
FIG. 6 is a cross-sectional view of the invention, taken generally along lines 6-6 of FIG. 5.

Referring to FIG. 1, the container 10 of the present invention includes an elongated housing 20 having at least one top side 30 that includes a top panel 35 with an elongated slot 40 therein. The elongated slot 40 is generally parallel to the length of the housing 20, which is substantially a parallelepiped and further includes three side panels 110 in addition to the top panel 35 (FIG. 6). The side panels 110 and the top panel 35 essentially form a hollow tube with a preferably square cross-section. Further, the housing 20 includes a first end panel 120 and a second end panel 125 (FIGS. 1 and 5). The first end panel 120 is preferably hingably connected to one side panel 115 at hinges 122 such that, when in an open position, access is provided to the inside of the housing 20. Alternately, the first end panel 120 may be slidably attached to the housing 20 without the need for using hinges 122. The housing 20 is preferably formed of a rigid plastic or other suitable material that is light-weight yet relatively strong. The housing may also be formed of sheet metal for industrial applications requiring more durability.

A substantially cylindrical barrel assembly 50 is supported within the housing 20 and is rotatable about an axis 60 that is generally parallel to the length of the housing 20. The barrel assembly 50 comprises a plurality of web roll storage cavities 70, each proximate to an outer surface 55 of the barrel assembly, and each cavity 70 having an open end 80 for receiving one web roll 90 therein. The open end 80 of each cavity faces the first end panel 120, such that access is provided to each cavity 70 when the first end panel 120 is in the open position. Further, each cavity 70 includes an open slot 100 along a length thereof and open to the outside surface 55 of the barrel assembly 50 (FIG. 6). The slot 100, as well as the elongated slot 40 in the top side 30, are each preferably wide enough to allow removal of the gift wrap roll 90 therethrough if desired.

With the barrel assembly 50 being supported within the housing 20, the barrel assembly 50 may be rotated within the housing 20 to align the open slot 100 of a desired web roll cavity 70 with the elongated slot 40 of the top side 30 of the housing 20. As such, one of the gift wrap rolls 90 stored in the desired cavity 70 of the barrel assembly 50 may be dispensed therethrough, either by manually removing the roll 90 or by grasping the gift wrap sheet itself and pulling. As the cavity 70 is generally cylindrical in shape, the gift wrap roll 90 will unwind within the cavity 70 when the gift wrap sheet is pulled, gravity holding the roll 90 within the cavity 70. As such, the container 10 provides for flexibility in dispensing the gift wrap 90.

Wedge-shaped detents (not shown) may be included in the corner panels 140 or the center ridges 130 to allow rotation of the barrel assembly 50 in only one direction, the paper rolls being inserted in such a way that they do not unroll when the barrel assembly 50 is rotated in the said one direction. Alternatively, horseshoe clips, stays, or hook-and-loop type straps, or the like, for keeping paper from unrolling may be wrapped around each roll 90.

To facilitate the rotation of the barrel assembly 50 within the housing 20, each side panel 110 and the top panel 35 includes an elongated concave center ridge 130 that is generally parallel to the length of the housing 20 and corresponds in curvature to the curvature of the outer surface 55 of the barrel assembly 50. In this manner the barrel assembly 50 is at least partially supported by at least one of the center ridges 130 when the barrel assembly 50 is supported within the housing 20 and the housing 20 is supported on a flat surface (not shown) on one of the side panels 110.

Further, arcuate corner panels 140 are frictionally retained between the center ridges 130 of each adjacent top panel 35 or side panel 110. As best illustrated in FIG. 6, such arcuate corner panels 140 cooperate in curvature with the concave center ridges 130 to form a generally cylindrical void 150 for rotatably retaining the barrel assembly 50 therein. The arcuate corner panels 140 each further form one side of a generally triangular open area within the housing 20 where additional rolls of gift wrap or other items (not shown) may be stored. Such open areas within the housing 20 can be easily accessed by opening the first end panel 120.

In the preferred mode of the invention, the barrel assembly 50 comprises a plurality of identical elongated cavity arcs 58, each of which are adapted for frictional engagement to one another, such that the plurality of assembled arcs 58 form the cylindrical barrel assembly 50. Each cavity arc 58 includes one of the web roll storage cavities 70 on an outer surface 59 thereof, and each cavity arc 58 includes an elongated tongue-and-groove section 57 on each side thereof for frictional engagement with a corresponding tongue-and-groove section 57 on one side of one of the other cavity arcs 58. As such the cavity arcs 58, being of uniform cross-section, may be extruded and thereby made relatively inexpensively from an extrudable material that becomes rigid, such as plastic, or the like. Further, such cavity arcs 58, when disassembled, may be stored together in a compact fashion with the other components of the container 10 for efficient shipping and retail display.

FIG. 6 illustrates a barrel assembly 50 having 11 arcs 58, each having opposite sides sloped approximately 32.7 degrees with respect to one another, so that 11 such arcs 58 assembled together form the 360 degree cylindrical barrel assembly 50. Clearly, however, barrel assembly 50 may have any number of different arcs 58 provided that the size of the arc 58 allows room for one cavity 70 and provided that the total number of arcs 58 together form a generally 360 degree cylindrical barrel assembly 50.

Preferably the barrel assembly 50 further includes a hollow portion from one end to the other thereof for storing additional gift wrap rolls 90 or other items. While gift wrap stored therein (not shown) is not dispensable through the open slot 40, such rolls are conveniently accessed by opening the first end panel 120. A support panel 53 may be further included (FIG. 6) for strengthening the barrel assembly 50 and for dividing the hollow portion into a plurality of sub-portions for allowing further organizing of any gift wrap rolls 90 stored therein.

Figure 2:
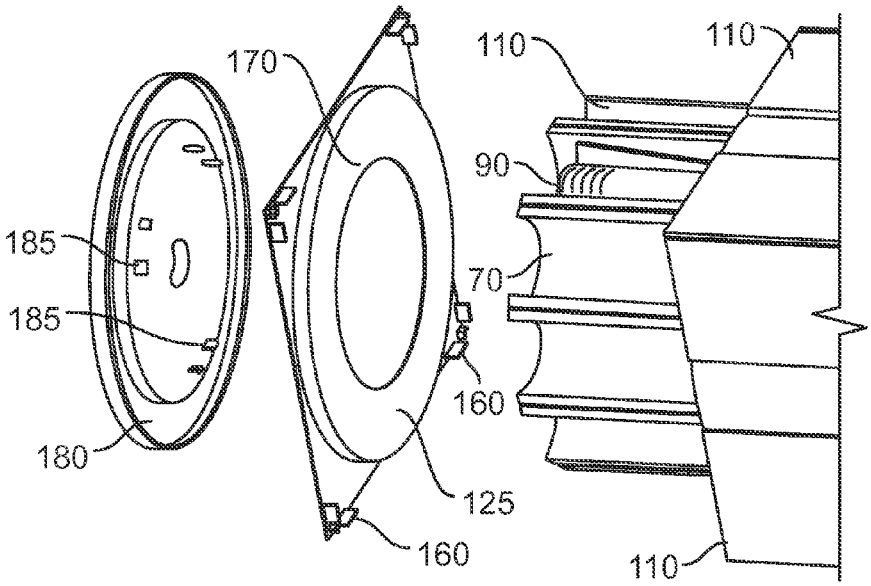
FIG. 2 is a partial exploded view of the invention, illustrating a rolled product contained in a storage cavity of the barrel assembly.

Referring now to FIGS. 1 and 2, the second end panel 125 preferably includes a circular cut-out 170 centered within the generally square end panel 125. A rotatable cap 180 is frictionally attached to one end of the barrel assembly 50 with locking tabs 185, the cap 180 at least partially protruding from the circular cut-out 170, such that rotating the cap 180 causes the barrel assembly 50 to rotate within the housing 20 when the second end panel 125 is fixed at one end of the housing 20. The second end panel 125 preferably includes locking tabs 160 for securing the second end panel 125 to the side panels 110 and the top panel 35 (FIG. 3), as is known in the art. Preferably a portion 126 of the second end panel 125 is offset towards the inside of the housing 20 from the rest of the second end panel 125 such that the cap 180 does not extend past the second end panel 125 when the container 10 is resting on the flat surface on its second end panel 125. In such a manner the container 10 is prevented from wobbling on the second end panel 125 when supported on the flat surface thereby.

Figure 3:
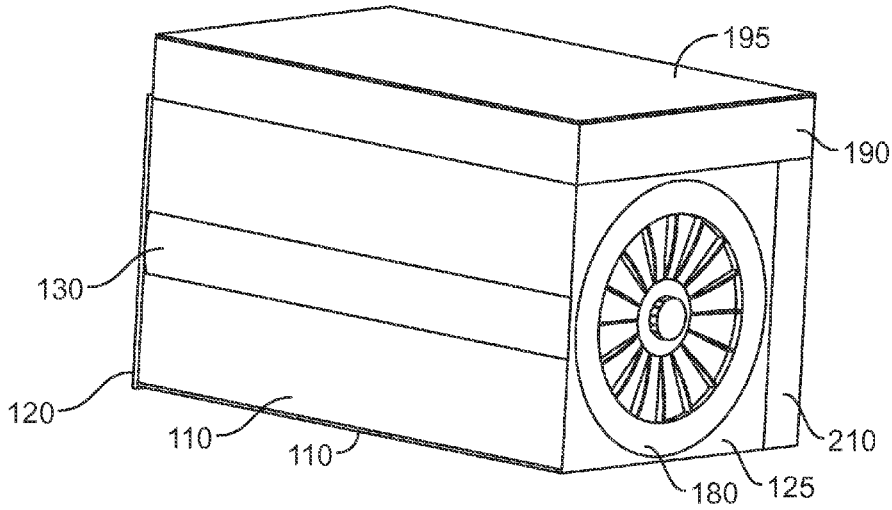
FIG. 3 is a perspective view of the invention as assembled, illustrating the housing with a first and second storage box fixed thereto, and further illustrating the rotating cap.
Figure 4:
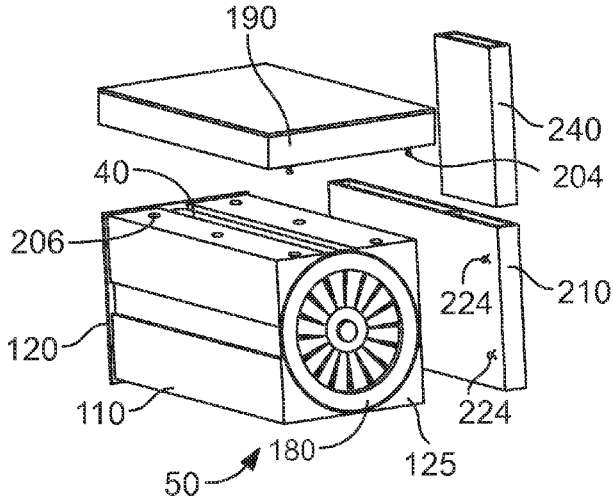
FIG. 4 is an exploded view of the invention, illustrating how the first storage box covers an elongated slot in the housing through which the rolled product may be dispensed, and further illustrating a third storage box contained in the second storage box.
Figure 4B:
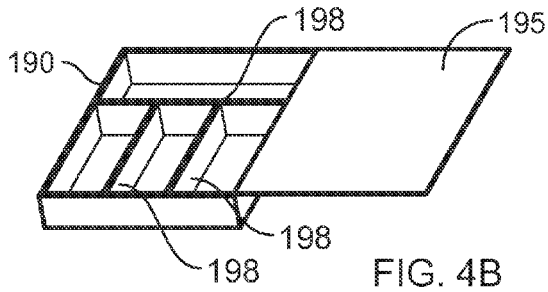
FIG. 4B is a perspective view of the first storage box in an open position.

A first storage box 190 is preferably included for covering the elongated slot 40 of the top side 30. The first storage box 190 and the top side 30 further include frictional engagement means 200 for temporarily securing the first storage box 190 to the top side 30 of the housing 20 (FIGS. 3 and 4). Preferably the frictional engagement means 200 includes a plurality of locking tabs 204 protruding from a bottom surface of the first storage box 190, and corresponding locking holes 206 formed in the top side 30 of the housing 20. In use, the first storage box 190 may be manually, frictionally retained on the housing 20, and then easily removed by pulling same manually away from the housing 20. The first storage box 190 is preferably made from the same plastic material as the housing 20, and further includes a top 195 that is hingably connected to the first storage box 190 on one side, and frictionally engages the first storage box 190 at the other side when closed. The top 195 is slightly deeper than the first storage box 190 so that a lip portion of the top 195 may be easily pressed upward away from the first storage box 190 to open the top 195. Items related to gift wrapping may be stored in the first storage box 190, and several compartments may be included to organize such items (FIG. 4).

A second storage box 210 is included for removable attachment to one of the side panels 115, the one side panel 115 being adjacent to the top side 30. A frictional engagement means 220, similar to that of the first storage box 190, is included for securing the second storage box 210 to the one side panel 115 of the housing 20. The second storage box 210 is preferably open on a side 230 adjacent to the top side 30 of the housing 20 when the second storage box 210 is fixed to the one side panel 115 (FIGS. 4 and 6). The frictional engagement means 220 preferably includes a plurality of locking tabs 224 protruding from a bottom surface of the second storage box 210, and corresponding locking holes 226 formed in the one side panel 115 of the housing 20, whereby the second storage box 210 may be frictionally secured on the housing 20. As such, with both the first storage box 190 and the second storage box 210 retained on the housing 20, the first storage box 190 covers the open side 230 of the second storage box 210, thereby keeping any items stored in the second storage box 210 retained therein. One such item is preferably a third storage box 240, sized accordingly to fit securely within a portion of the second storage box 210. The second and third storage boxes 210, 240 are preferably each made from the same rigid plastic material as the first storage box 190.

Wheels 250 may be included in the side panel 125, or on opposing side panels 110, such that when the container is rested on the wheels 250 the container may be easily rolled along a surface (not shown). A handle (not shown) may be included on or formed in a part of the housing 20 opposite the wheels 250 to facilitate the rolling the housing 20 along the surface.

In use, the container 10 is assembled and the first end panel 120 is opened so that various gift wrap rolls may be inserted into the open ends of the web roll cavities 70, the hollow sections of the barrel assembly 50, and the triangular portions formed between the arcuate corner panels 140 and the side panels 110 and top panel 35. With the first end panel 120 closed, the user removes the first storage box 190 and rotates the cap 180 such that a desired gift wrap roll 90 becomes aligned with the elongated slot in the top side 30. The roll 90 is either removed entirely from the cavity 70, or the gift wrap paper sheet itself is grasped and pulled from the roll 90 until a desired length is unrolled. Optionally, an edge (not shown) of the elongated slot may be formed as a sharp acute angle such that pulling the gift wrap against such edge with one hand while holding the gift wrap roll 90 firmly inside the cavity 70 such that it cannot further unroll results in a clean tear of the gift wrap at the desired length. Such a sharp edge may be reinforced with a metallic or other suitable blade-like structure, if desired.

Accessories stored in any of the boxes 190, 210, 240 may be removed to facilitate the wrapping of, for example, a gift (not shown). Upon completion thereof, the user stows said accessories and re-assembles the container 10. The container 10 may then be put into a closet or into another convenient storage area until needed again. Further, the regular shape of the housing 20 provides for stable storage of the container 10 either in a vertical or horizontal orientation. All gift wrap rolls and accessories therefore remain organized within the container 10.

While a particular form of the invention has been illustrated and described, it will be apparent that various modifications can be made without departing from the spirit and scope of the invention. For example, the materials used to manufacture the housing 20, barrel assembly 50, and storage boxes 190, 210 and 240 may vary based on the needs of the environment in which the container 10 will be used, provided same are made from a rigid material. Further, wheels 250 may or may not be included, and the exact number of arcs 58 may vary as to the needs of the environment and the size of the web rolls 90 with which the container 10 will be used. Accordingly, it is not intended that the invention be limited, except as by the appended claims.

What is claimed is:

1. A web roll storage and dispensing container comprising:

an elongated housing having at least one top side, the top side including an elongated slot generally parallel to the length of the housing; and a generally cylindrical barrel assembly supported within the housing and rotatable about an axis generally parallel to the length of the housing, the barrel assembly comprising a plurality of web roll storage cavities each proximate to an outer surface of the barrel assembly, each cavity having an open end for receiving one web roll therein, each cavity further including an open slot along a length thereof and open to the outside surface of the barrel assembly; and a first storage box for covering the elongated slot of the top side, the first storage box and the top side further including frictional engagement means for securing the first storage box to the top side of the housing, the frictional engagement means including a plurality of locking tabs protruding from a bottom surface of the first storage box, and corresponding locking holes formed in the top side of the housing;

whereby the first storage box may be frictionally retained on the housing, and the barrel assembly may be rotated to align the open slot of a desired web roll cavity with the elongated slot of the top side of the housing such that one of the web rolls stored in the desired cavity of the barrel assembly may be dispensed therethrough.

2. A web roll storage and dispensing container comprising:

an elongated housing having at least one top side, the top side including an elongated slot generally parallel to the length of the housing; and a generally cylindrical barrel assembly supported within the housing and rotatable about an axis generally parallel to the length of the housing, the barrel assembly comprising a plurality of web roll storage cavities each proximate to an outer surface of the barrel assembly, each cavity having an open end for receiving one web roll therein, each cavity further including an open slot along a length thereof and open to the outside surface of the barrel assembly;

a first storage box for covering the elongated slot of the top side, the first storage box and the top side further including frictional engagement means for securing the first storage box to the top side of the housing; and a second storage box for removable attachment to one of the side panels, the second storage box and the one of the side panels further including frictional engagement means for securing the second storage box to the one of the side panels of the housing, the one of the side panels being adjacent to the top side of the housing, the second storage box being open on a side thereof adjacent to the top side of the housing;

whereby the barrel assembly may be rotated to align the open slot of a desired web roll cavity with the elongated slot of the top side of the housing such that one of the web rolls stored in the desired cavity of the barrel assembly may be dispensed therethrough.

3. The container of claim 2 wherein the frictional engagement means includes a plurality of locking tabs protruding from a bottom surface of the second storage box, and corresponding locking holes formed in the one of the side panels of the housing, whereby the second storage box may be frictionally retained on the housing.

4. The container of claim 3 wherein with the first storage box retained on the top side of the housing, and the second storage box retained on the one side panel of the housing, the first storage box covers the open side of the second storage box.

5. The container of claim 4 further including a third storage box with dimensions adapted to fit securely within a portion of the second storage box.

* * * * *